US008104719B2

(12) United States Patent
Shiau et al.

(10) Patent No.: US 8,104,719 B2
(45) Date of Patent: Jan. 31, 2012

(54) DIGITAL INTERFACE UNIT (DIU) AND METHOD FOR CONTROLLING STAGES OF A MULTI-STAGE MISSLE

(75) Inventors: Chin Shiau, Tucson, AZ (US); Andrew Facciano, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/281,804

(22) Filed: Nov. 17, 2005

(65) Prior Publication Data

US 2008/0092765 A1 Apr. 24, 2008

(51) Int. Cl.
*B64G 1/24* (2006.01)

(52) U.S. Cl. ..... 244/171.3; 244/3.1; 102/378

(58) Field of Classification Search ..... 244/3.1, 244/171.3; 102/377, 378
See application file for complete search history.

(56) References Cited

U.S. PATENT DOCUMENTS

| | | | | |
|---|---|---|---|---|
| 4,096,802 | A * | 6/1978 | Waln | 102/378 |
| 4,964,340 | A * | 10/1990 | Daniels et al. | 102/377 |
| 6,169,981 | B1 * | 1/2001 | Werbos | 706/23 |
| 6,608,589 | B1 | 8/2003 | Devereux et al. | 342/357.06 |
| 7,137,588 | B2 | 11/2006 | Humphrey | |
| 7,152,134 | B2 | 12/2006 | Kinstler | |
| 7,444,454 | B2 * | 10/2008 | Yancey et al. | 710/312 |
| 2003/0145150 | A1 * | 7/2003 | Yoshida | 710/315 |
| 2004/0015637 | A1 * | 1/2004 | Yau | 710/313 |
| 2004/0148069 | A1 | 7/2004 | Marshall et al. | 701/13 |
| 2005/0178886 | A1 | 8/2005 | Potter et al. | |
| 2006/0069689 | A1 * | 3/2006 | Karklins et al. | 707/100 |
| 2008/0092765 | A1 | 4/2008 | Shiau et al. | |
| 2008/0155489 | A1 * | 6/2008 | Komatsu et al. | 716/10 |

FOREIGN PATENT DOCUMENTS

| | | | |
|---|---|---|---|
| CN | 1 403 781 | A | 3/2003 |
| CN | 1403781 | | 3/2003 |
| RU | 2 238 226 | C2 | 10/2004 |
| RU | 2238226 | C2 | 10/2004 |
| WO | WO-2008088330 | A2 | 7/2008 |

OTHER PUBLICATIONS

Wikipedia: "Saturn V Instrument Unit" Internet Article, Sep. 30, 2006, XP002490729. Retrieved from the Internet.

(Continued)

*Primary Examiner* — Stephen M Johnson
(74) *Attorney, Agent, or Firm* — Schwegman, Lundberg & Woessner, P.A.; Gregory J. Gorrie

(57) ABSTRACT

A multi-stage missile with plural stages adapted to be physically coupled to and decoupled from adjacent stages and a processor disposed on a single stage for controlling each stage thereof. In the illustrative embodiment, the processor includes a field programmable gate array. In the illustrative embodiment, the processor is disposed on stage 4 of a four-stage missile and performs guidance and navigation functions for each stage and control functions for stages 2, 3 and 4. In a specific embodiment, a serial bus interface is included for coupling the processor to electronic circuitry on each of the stages of the missile. In the best mode, the interface is an IEEE 1394b interface with a physical layer interface and a link layer interface.

10 Claims, 6 Drawing Sheets

OTHER PUBLICATIONS

Wikipedia: "Image:Saturn instrument Unit.jpg" Internet Article, XP002494530. Retrieved from the Internet.
URL addresses not considered to be documents.
"Image: Saturn Instrument Unit", XP002494530, [Online]. Retrieved from the Internet: <URL: http://en.wikipedia.org/wiki/File:Saturn_instrument_Unit.jpg>, 6 pgs Aug. 9, 2009.
"International Application Serial No. PCT/US2007/001295, International Search Report mailed Sep. 15, 2008", 1 page.
"Saturn V", XP002490730, [Online]. Retrieved from the Internet: <URL: http://en.wikipedia.org/w/index.php?title=Saturn_V&oldid=78106996>, (Retrieved Jul. 28, 2008), 16 pgs.
"Saturn V Instrument Unit", XP002490729, [Online]. Retrieved from the Internet: <URL: http://en.wikipedia.org/w/index.php?title=Saturn_v_Instrument_Unit&oldid=78609048>, (Retrieved Jul. 28, 2008), 1 pg.

* cited by examiner

DIGITAL INTERFACE UNIT (DIU) AND METHOD FOR CONTROLLING STAGES OF A MULTI-STAGE MISSLE

BACKGROUND OF THE INVENTION

1. Field of the Invention

The present invention relates to electrical and electronic circuits and systems. More specifically, the present invention relates to electrical and electronic circuits and systems used for missile guidance and control.

2. Description of the Related Art

The threat posed by nuclear ballistic missiles has prompted an interest in an interceptor missile capable of destroying ballistic missiles in flight. To destroy a ballistic missile early in its flight, the interceptor missile must have a long-range capability. Currently, a long-range capability necessitates a multi-stage missile interceptor design.

Multi-stage missiles typically have booster vehicles and payload assemblies with separate avionics suites to provide independent auto pilot, guidance and navigation, tracking, mid-course communication, and target discrimination functions. The booster hands off mission responsibilities after payload ejection to the KV (kill vehicle).

Unfortunately, separate booster and payload avionic processing increases design and assembly complexity and costs with the incorporation of redundant electronic hardware, oversized harness cabling, additional power resources, and associated required mechanical packaging hardware.

This architecture was previously necessitated by limited processing capabilities, which required large dedicated processors to be networked throughout the system. This was also due, at least in part, to the fact that typically, each stage is manufactured by a different manufacturer and each manufacturer includes a processor to control electronic circuitry in each stage to insure proper and timely operation.

In addition, typically, connections between stages of multi-stage interceptor missiles are generally point-to-point serial interfaces with the number of interfaces required being related to the number of stages (N) in a factorial relationship (N!). For example, a three-stage interceptor typically requires six interfaces (3×2×1), while a four stage vehicle typically requires twenty-four interfaces (4×3×2×1). These interfaces require cabling that adds to the weight of the missile, increases its cost and limits its performance. This approach also lead to complex interconnections and interface communication protocols between independent units, further complicating software integration, assembly and test requirements.

Hence, a need exists in the art for a lightweight, low cost, high-performance multi-stage missile interceptor. Specifically, a need remains in the art for a system or method for reducing the cost and weight associated with inter-stage connections in a multi-stage missile.

SUMMARY OF THE INVENTION

The need in the art is addressed by the multi-stage missile of the present invention. In the most general embodiment, the inventive missile includes plural stages adapted to be physically coupled to and decoupled from adjacent stages and a processor disposed on a single stage for controlling each stage of the missile.

In the illustrative embodiment, the processor includes a field programmable gate array. In the illustrative embodiment, the processor is disposed on stage 4 of a four stage missile and performs guidance and navigation functions for each stage and control functions for stages 2, 3 and 4.

In a specific embodiment, a serial bus interface is included for coupling the processor to electronic circuitry on each of the stages of the missile. In the best mode, the interface is an IEEE 1394b interface with a physical layer interface and a link layer interface.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
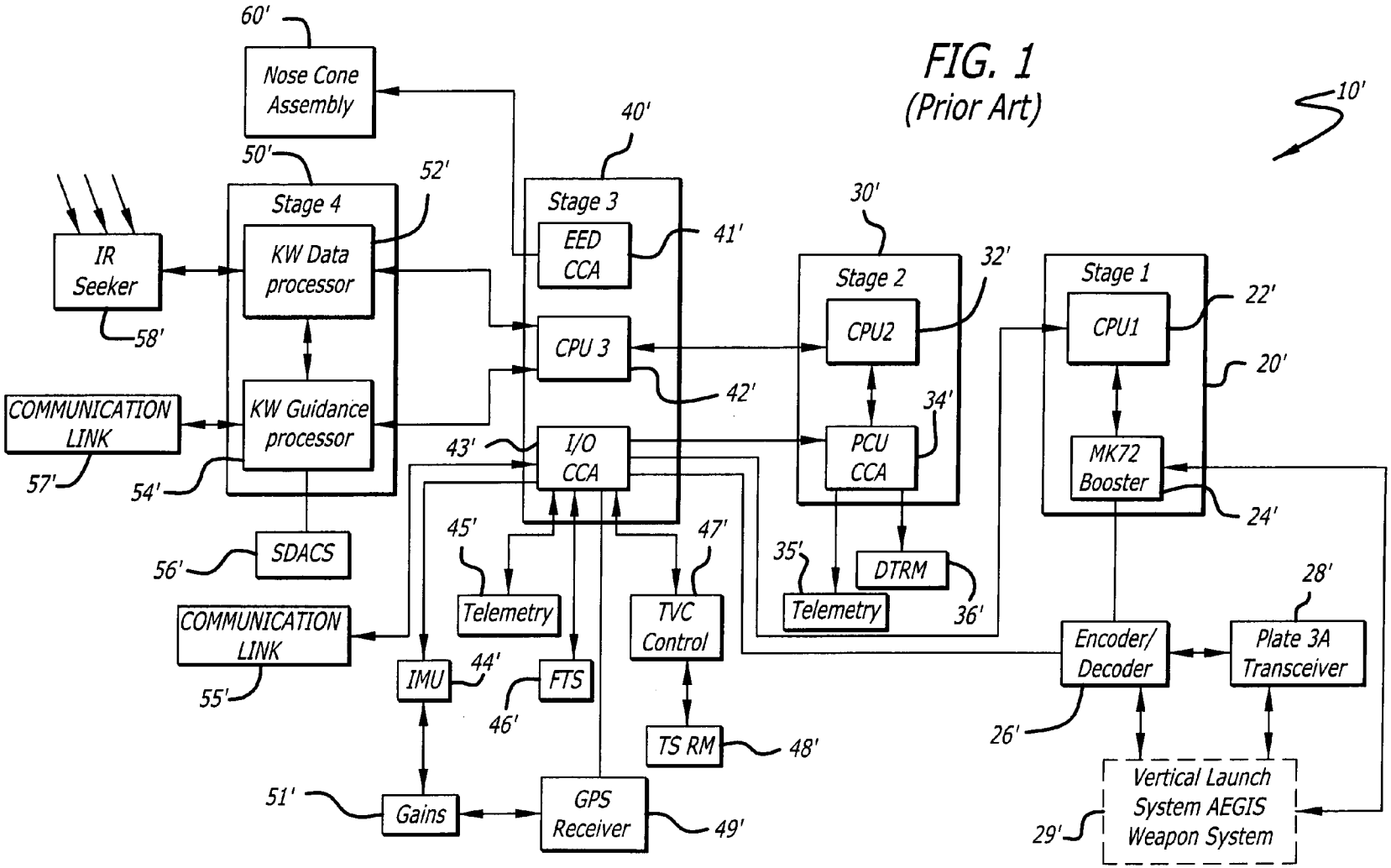
FIG. 1 (Prior Art)
FIG. 1 is a simplified block diagram of the navigation, guidance and control system of a typical multi-stage interceptor missile implemented in accordance with conventional teachings.

FIG. 1 is a simplified block diagram of the navigation, guidance and control system of a typical multi-stage interceptor missile implemented in accordance with conventional teachings. The system 10' includes four stages 20', 30', 40' and 50'. Stage 1 20' has a first central processing unit (CPU1) 22' which controls a booster motor 24'. The booster 24' is initiated by a weapon system controller 29'.

In accordance with conventional teachings, the second stage 30' has a second CPU 32' which controls a Power Condition Unit (PCU CCA) 34'. The PCV CCA 34' communicates with a telemetry unit 35' and a Dual Thrust Rocket Motor (DTRM) 36'.

The third stage 40' has a third CPU 42' which communicates with an inertial measurement unit 44', a telemetry system 45', a Flight Termination System (FTS) 46', a Global Positioning Satellite (GPS) receiver 49' and a Thruster Vector Control (TVC) controller 47' via an input/output Circuit Card Assembly (CCA) unit 43'. The IMU is coupled to the GPS receiver 49' via a GPS Aided Navigation System (GAINS) 51'. The third CPU is also in communication with the nose cone assembly 60' via a Electrical Explosive Device (EED CCA) 41'. The I/O CCA communicates via a communication link 55'.

The fourth stage 50' is a fourth CPU which performs data processing (52') and guidance processing (54'). The data processor 52' is coupled to an infrared seeker 58'. The guidance processor 54' is coupled to a Solid Divert Altitude Control System (SDACS) 56'. Communication with the fourth stage is effected via a second communication link 57'.

In accordance with the present teachings, an interceptor is disclosed which is configured to concentrate micro-processing functions into a single computer located within the Kill Vehicle (KV) or payload, instead of each booster stage. The inventive system incorporates a single-node-centric, micro-processing system that performs auto pilot, guidance and navigation, tracking, and target discrimination functions for the vehicle flight from booster launch egress to target interception.

In the illustrative embodiment, the system is scalable allowing for the vehicle to be configured with any number of rocket motor stages. This enables a reconfiguration of the overall vehicle design without impacting the electronic architecture. In addition, the communication interfaces between the stages is simplified by the use of an IEEE 1394b bus interface.

Figure 2A:
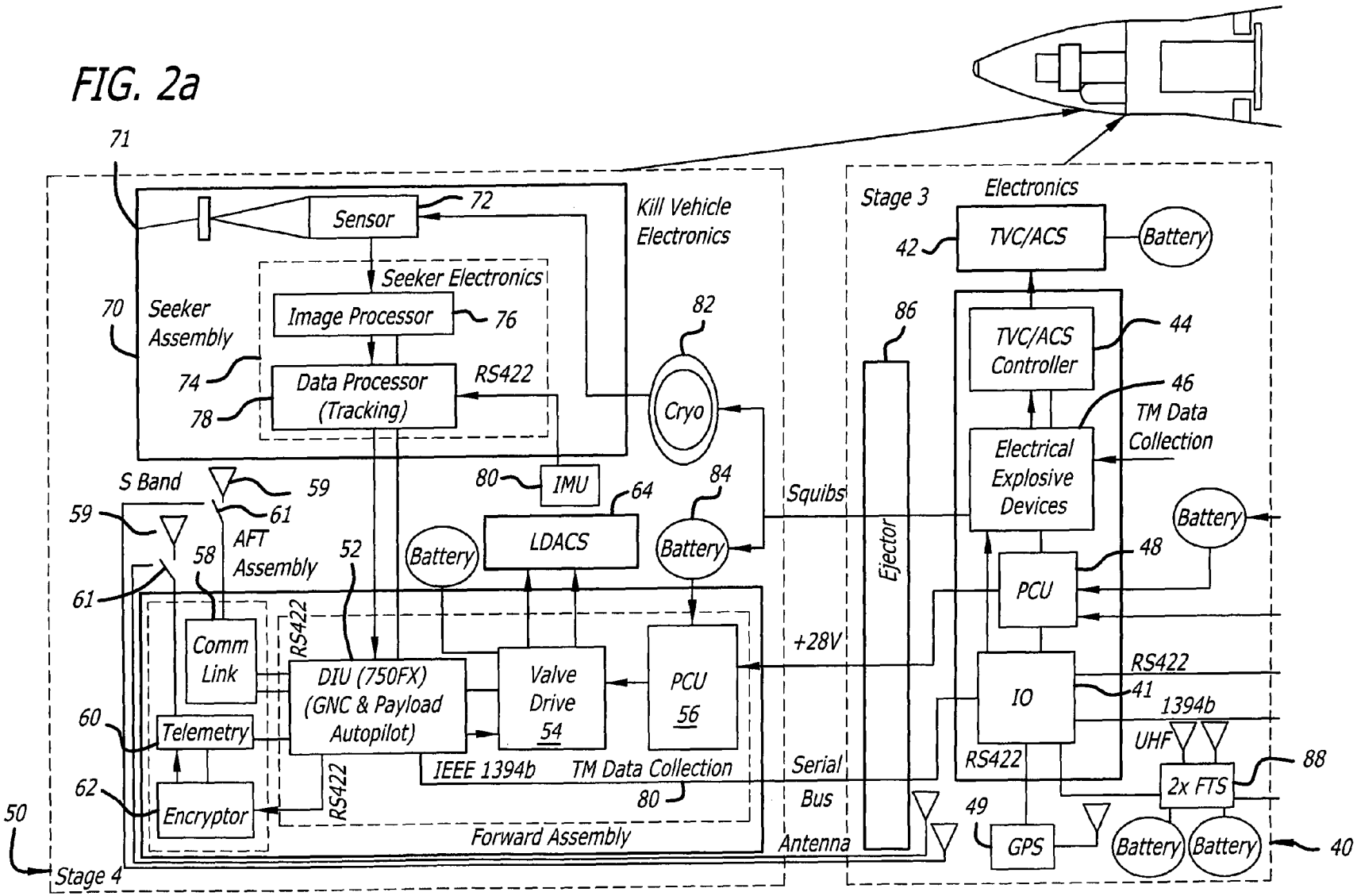
FIGS. 2*a* and 2*b* show a block diagram showing an illustrative implementation of a navigation, guidance and control system of a multi-stage interceptor missile implemented in accordance with the teachings of the present invention.
Figure 2B:
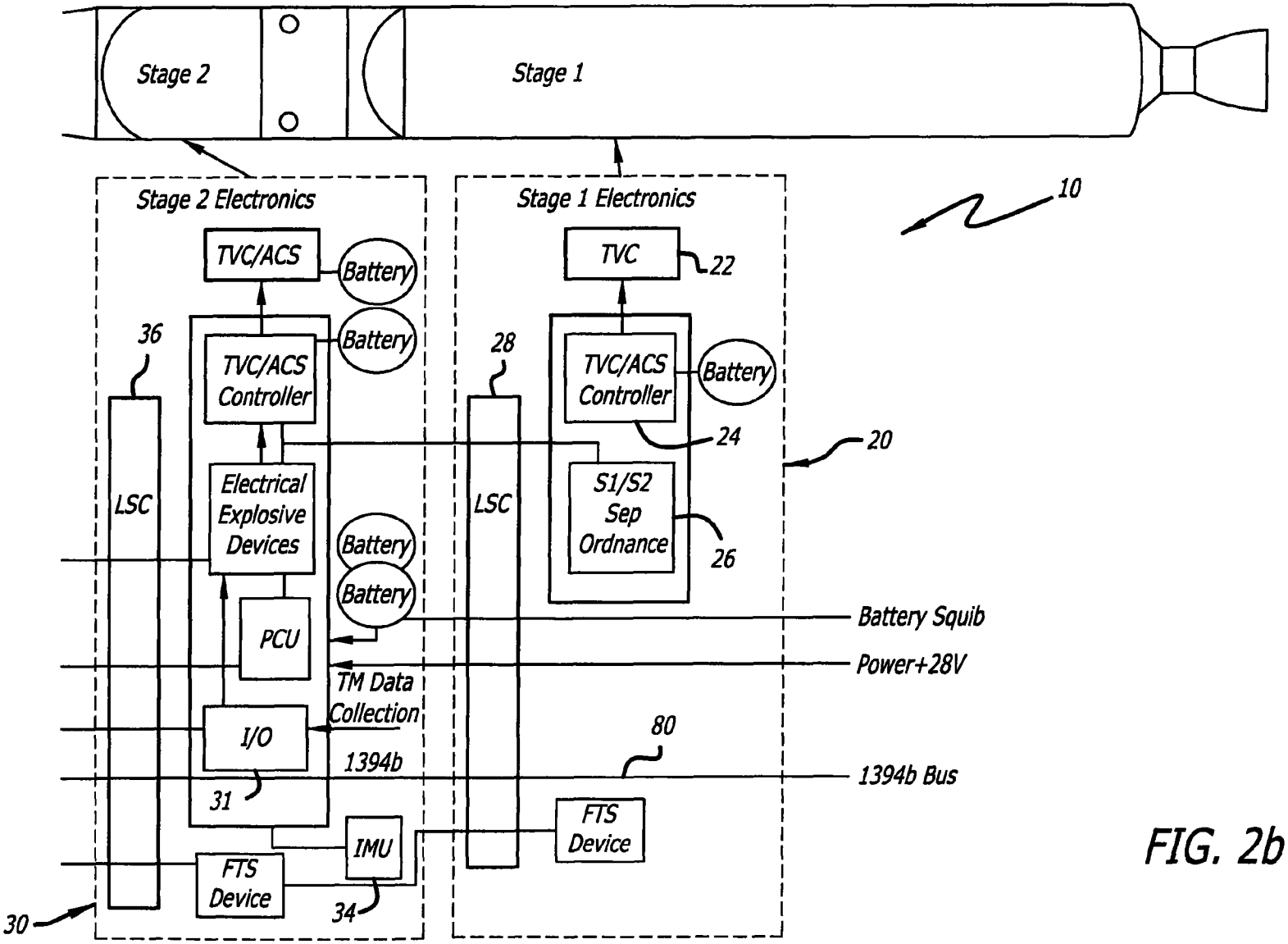

FIGS. 2*a* and 2*b* show a block diagram showing an illustrative implementation of a navigation, guidance and control system of a multi-stage interceptor missile implemented in accordance with the teachings of the present invention. As per the system 10' of FIG. 1, the inventive system 10 includes a first stage electronics module 20, a second stage module 30, a third stage module 40 and a fourth stage module 50. However, in accordance with the present teachings, a single CPU 52 is provided in the fourth stage 50 in lieu of a CPU in each preceding stage as shown in FIG. 1. As a result, each stage functions with simplified electronic circuitry. Fewer interfaces and less cabling are required between stages. This is illustrated in FIGS. 2*a* and 2*b*.

As shown in FIG. 2*a*, the fourth stage 50 includes a digital interface unit (DIU) 52 that performs guidance, navigation and control functions along with payload maintenance and autopilot navigation. The DIU 52 is disposed on a forward assembly along with a conventional valve drive unit 54 and a power conditioning unit (PCU) 56. The DIU 52 communicates through a conventional communications link 58 and antenna 59*a* via a switch 61*a*. Telemetry is provided to the DIU via a telemetry unit 60, an encryption circuit 62, switch 61*b* and antenna 59*b*. The DIU controls the switch 61*b* and allows the telemetry unit 60 to use an antenna on stage 3 or an antenna on stage 4.

The valve drive 54 operates through a conventional liquid divert attitude and control system (LDACS) 64. A conventional seeker assembly 70 is included with a sensor 72 and an electronics package 74. The seeker electronics package 74 includes an image processor 76 and a data processor 78. A cryogenics unit 82 cools the focal plane array 71 of an infrared sensor 72 in the seeker assembly 70. Numerous batteries are deployed throughout the system as is common in the art.

The data processor 78 receives inputs from an IMU 81 and communicates with the DIU 52. The DIU 52 communicates with the electronics subsystems in the first, second and third stages via a serial bus interface 80. In the preferred embodiment, the serial bus interface 80 is an IEEE 1394b interface. In the illustrative embodiment, the IEEE 1394b bus is a six-wire cable interface that extends through stages 3, 2 and 1 and the interstage interfaces are identical.

The third stage electronics subsystem includes a thrust vector controller (TVC) and attitude control system (ACS) 42 and a controller 44 therefor. The controller 44 may be implemented with discrete logic, application specific integrated circuit or other suitable arrangement. The controller 44 receives guidance, navigation and autopilot commands from the DIU 52 through the bus 80 and provides thrust vector and attitude control signals in response thereto.

The controller 44 is coupled to electrically activated explosive devices 46, a power conditioning unit (PCU) 48 and input/output interface 41. The I/O interface 41 receives vehicle location data from an onboard GPS receiver 49 and communicates with the DIU 52 on stage 4 via the serial bus 80. The I/O interface 41 and bus 80 allow GPS, guidance, attitude control and other stage related data to be forwarded to the DIU 52 and allow the DIU to trigger the ejection of the stage by activating the electrical explosive devices 46. On activation of the explosive devices, a squib is sent to a mechanical ejector 86 to effect separation of the stage. The squib is a high-energy pulse that serves to activate a battery 84 in the fourth stage. The squib pulse is also applied to the cryogenics unit 82. A conventional flight termination system (FTS) 88 is included in third stage as is common in the art.

The second stage electronics package 30 is coupled to the DIU 52 via the serial bus 80. The second stage is similar to the third stage 40 with the exception that an IMU 34 is included in the second stage along with a linear shaped charge (LSC) 36 for mechanical separation. There is no CPU in second stage electronics package 30. An Input Output (I/O) Controller 31 collects telemetry and inertial measurement unit data.

The electronics package for the first stage 20 includes a thrust vector controller 22, TVC drivers 24, separation ordinance 26 and an LSC 28. As per the second and third stages, the first stage 20 is coupled to the DIU 52 via the bus 80.

Note that the only connections required between stages are for antenna, serial bus, power supply and squib.

The system 10 is 'centric' in that the software required for guidance and control of multiple stages is concentrated in one stage. In the illustrative embodiment, the software is executed by the DIU 52 in the fourth stage. However, the present teachings are not limited thereto. Specific purpose processors and processors implemented in hardware may be used in lieu of the general purpose CPU of the DIU without departing from the scope of the present teachings. In addition, the centric processor may be located on stages other than stage 4.

Figure 3:
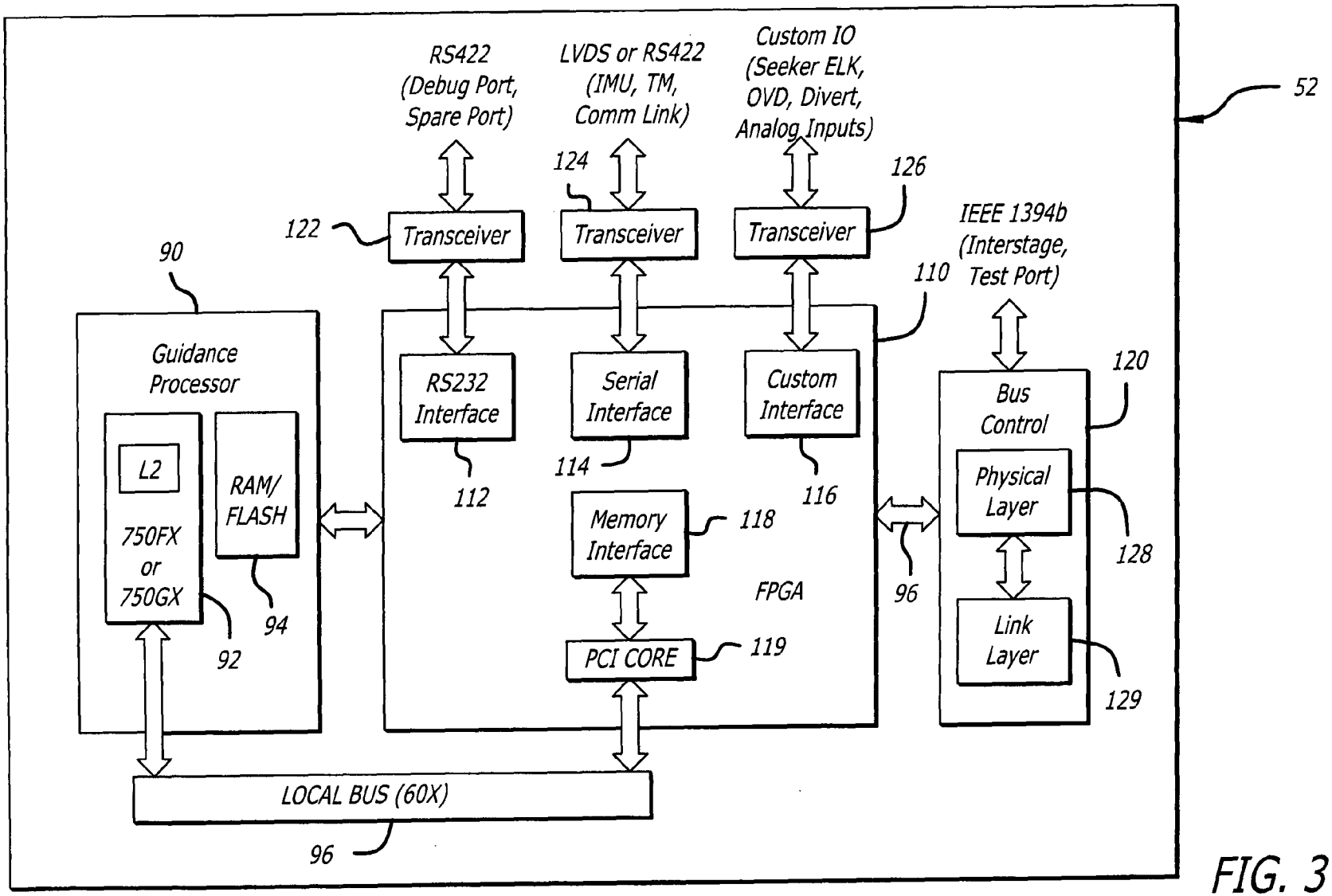
FIG. 3 is a block diagram of an illustrative implementation of the digital interface unit in accordance with the present teachings.

FIG. 3 is a block diagram of an illustrative implementation of the digital interface unit in accordance with the present teachings. In the illustrative implementation of FIG. 3, the DIU 52 includes a guidance processor 90, a field programmable gate array (FPGA) 110, and an IEEE 1394b bus controller 120. In the illustrative embodiment, the guidance processor 90 includes three PC 750FX or PC 750GX processors with L2 cache 92 and nonvolatile RAM and Flash memory 94. As discussed more fully below, the system is scalable to allow for the addition of processors and stages with minimal cost, weight and complexity.

The FPGA 110 may be implemented with a Xilinx Virtex II Pro or equivalent gate array. The FPGA 110 handles various interrupts and is provided with an RS 232 interface code module 112, a serial interface 114 and a custom interface 116. The RS 232 interface communicates with a debug port (not shown) or a spare port (not shown) via a first transceiver 122 and an RS 422 interface. The serial interface 114 communicates with the communications link 58, telemetry unit 60, and IMU 81 via a second transceiver 124 and a Low Level Differential Signal (LVDS) or RS 422 interface. The custom interface 116 communicates with seeker electronics 70, ordinance valve driver (not shown), Liquid Divert Altitude Control (LDAC) 64 and other analog devices via a third transceiver 126 and a custom I/O interface.

The FPGA 110 further includes a memory interface 118 and a Peripheral Computer Interface (PCI) core 119. The FPGA 110 communicates with the guidance processor 90 and the bus controller 120 via a local bus 96. The FPGA 110 includes plural ports, interfaces and interface logic circuits to enable multiple processors to be added to the DIU 52. This is illustrated in FIG. 4.

Figure 4:
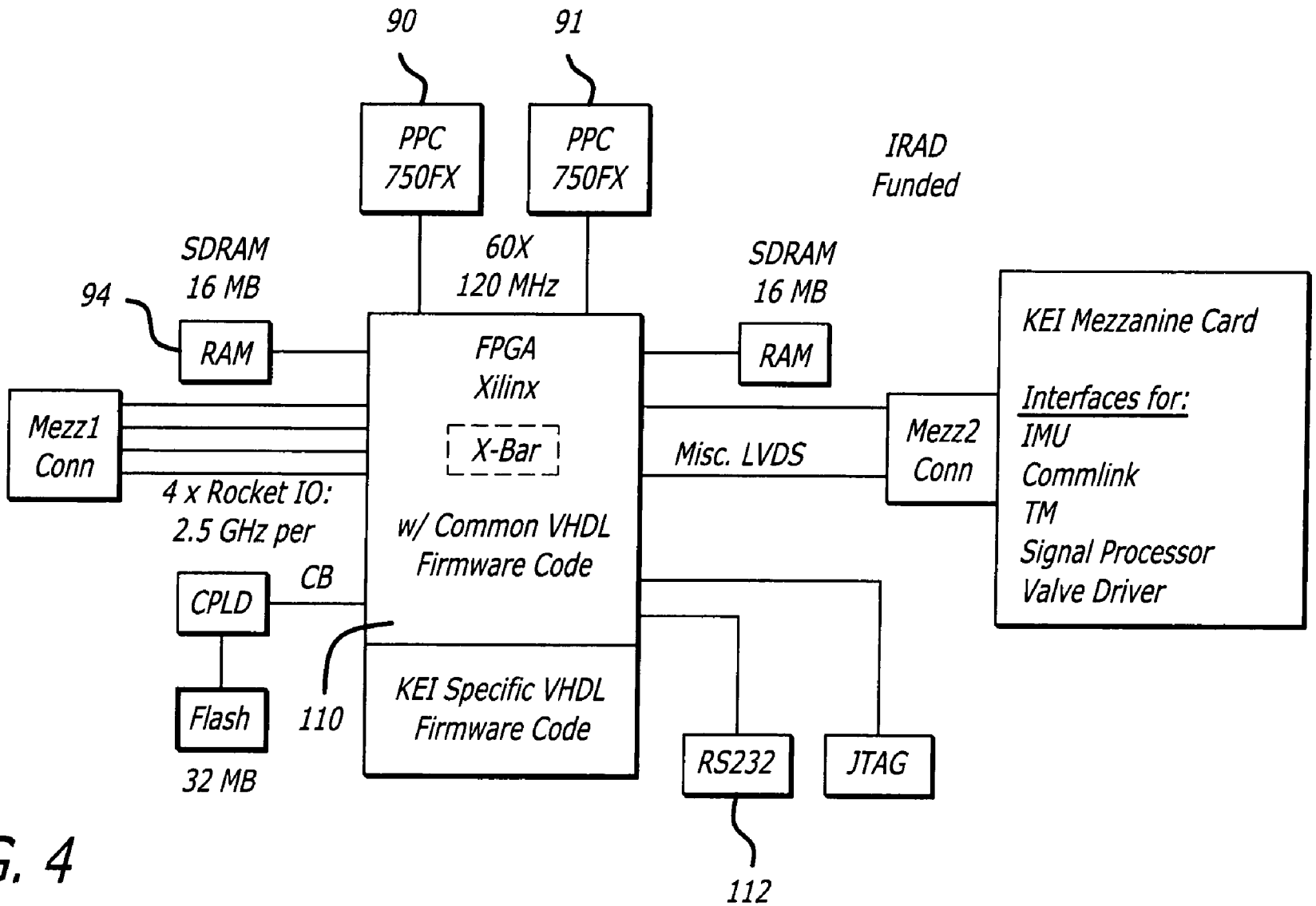
FIG. 4 is a simplified block diagram showing an illustrative arrangement by which a digital interface unit is scaled by the addition of a second processor in accordance with the present teachings.

FIG. 4 is a simplified block diagram showing an illustrative arrangement by which a digital interface unit is scaled by the addition of a second processor in accordance with the present teachings. In FIG. 4, guidance processor 90 and second processor are coupled to the system 10 via the FPGA 110.

Returning to FIG. 3, the bus controller 120 provides IEEE 1394b connectivity between stages and a test port (not shown). This bus allows for "daisy chain" interconnection betweens stages for design simplicity and robustness. The bus controller 120 includes a physical layer 128 and a link layer 129 and is otherwise conventional in design and function.

Hence, the system architecture through each of the stages is scalable. The FPGA design and IEEE 1394b bus interconnection between stages allows for the addition and deletion of stages without adding complexity. Hence, processor, circuitry and cabling cost and weight requirements are reduced.

Figure 5:
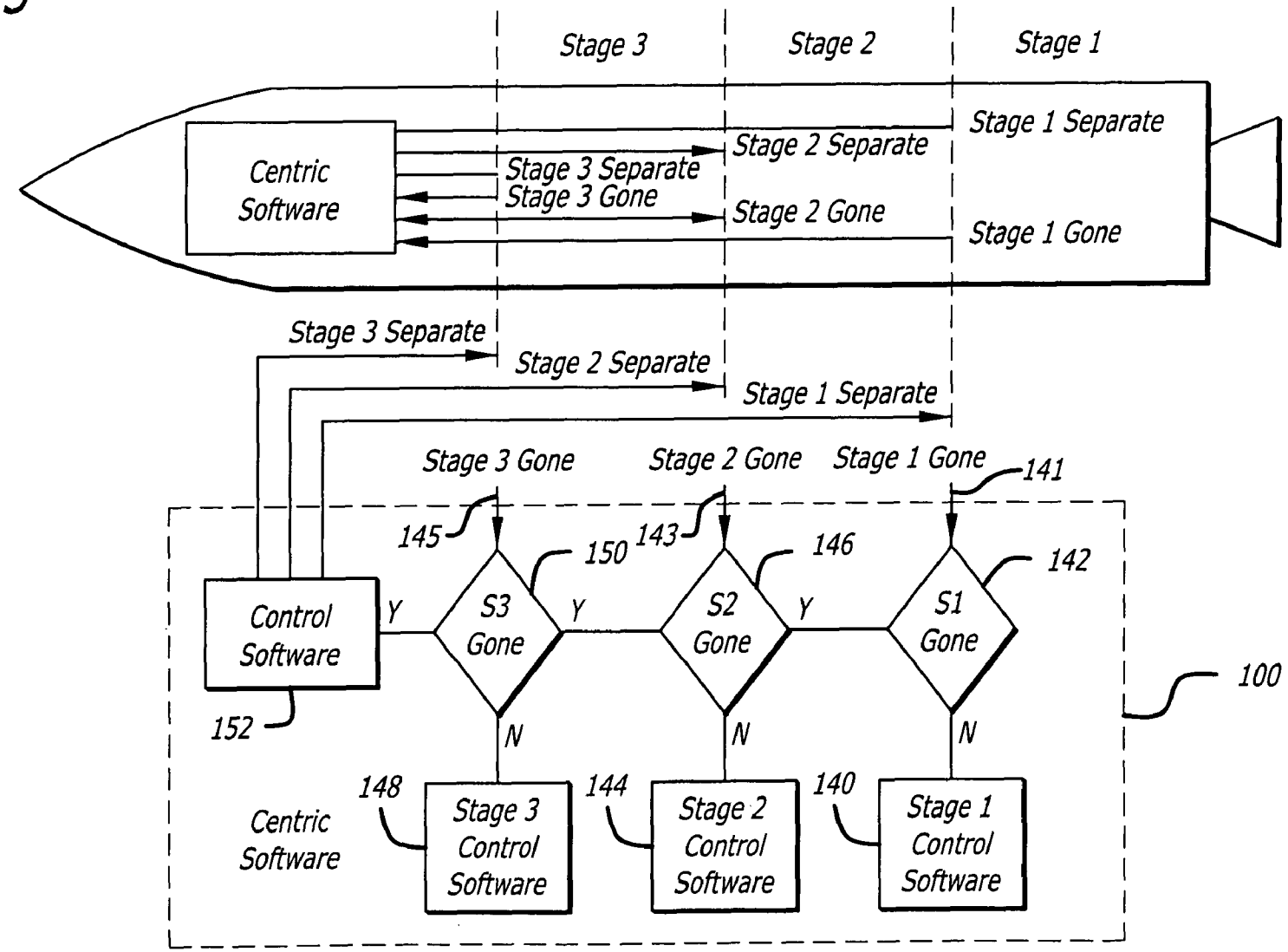
FIG. 5 is a flow diagram of an illustrative implementation of software executed by the guidance processor of the digital interface unit of the present invention.

FIG. 5 is a flow diagram of an illustrative implementation of software executed by the guidance processor of the digital interface unit of the present invention. The software 100 includes stage 1 control software 140. When stage 1 separation is ordered by the DIU 52 (FIG. 2*a*), stage 1 separates and a 'Stage 1 Gone' signal 141 is sent to the DIU by a signal from stage 2. At step 142, the software 100 checks for the presence of this signal and activates Stage 2 control software (step 144) on receipt thereof.

Similarly, when stage 2 separation is ordered by the DIU, stage 2 separates and a 'Stage 2 Gone' signal 146 is sent to the DIU by a signal from stage 3. At step 146, the software 100 checks for the presence of this signal and activates Stage 3 control software (step 148) on receipt thereof. Finally, when stage 3 separation is ordered by the DIU, stage 3 separates and a 'Stage 3 Gone' signal 145 is sent to the DIU by a signal from stage 4 (the nose assembly). At step 150, the software 100 checks for the presence of this signal and activates Stage 4 (terminal) control software 152 on receipt thereof.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A digital interface unit (DIU) configured to be disposed on a final stage of a multi-stage missile, the DIU comprising:

a gate array having plural ports, interfaces and interface logic circuits for interconnecting and disconnecting multiple processors;

a first processor coupled to the gate array; and a second processor coupled to the first processor via the gate array, wherein the DIU is configured to perform guidance and navigation functions for each of the stages of the multi-stage missile and control functions for only some of the stages through a serial bus interface that provides a daisy-chain interconnection between the stages, wherein at least one of the processors is a guidance processor that is configured with stage-control instructions to perform the guidance and navigation functions of the stages, wherein the gate array is a field programmable gate array (FPGA) to configure the guidance processor with the stage-control instructions for a currently-controlled stage, wherein the guidance processor is configured to execute stage-control instructions for the currently-controlled stage prior to separation of the currently-controlled stage, wherein the DIU is configured to order stage separation and provide a stage-gone signal to the guidance processor, and wherein the stage-control instructions are configured to check for the presence of the stage-gone signal and cause the FPGA to configure the guidance processor with stage-control instructions for controlling a next stage in response thereto.

2. A multi-stage missile comprising a plurality of stages adapted to be physically coupled to and decoupled from adjacent stages, the missile comprising:

a digital interface unit (DIU) disposed on a final stage configured to perform guidance and navigation functions for each of the stages and control functions for only some of the stages; and a serial bus interface to couple the DIU to electronic circuitry on each of the stages, the serial bus interface to provide a daisy-chain interconnection between the stages, wherein the DIU includes:

a guidance processor configured with stage-control instructions to perform the guidance and navigation functions of the stages;

a field programmable gate array (FPGA) to configure the guidance processor with the stage-control instructions for a currently-controlled stage; and a bus controller configured to control the serial bus interface, wherein the guidance processor is configured to execute stage-control instructions for the currently-controlled stage prior to separation of the currently-controlled stage.

3. The multi-stage missile of claim 2 wherein the DIU is configured to order stage separation and provide a stage-gone signal to the guidance processor, and wherein the stage-control instructions are configured to check for the presence of the stage-gone signal and cause the FPGA to configure the guidance processor with stage-control instructions for controlling a next stage in response thereto.

4. The multi-stage missile of claim 3 wherein the final stage is a fourth stage, and wherein the multi-stage missile includes first, second and third stages, wherein the fourth stage includes a payload, wherein the third stage includes a third stage controller to receive guidance, navigation and autopilot commands from the DIU through the serial bus interface and to provide thrust vector and attitude control signals in response thereto, and wherein the third stage controller is coupled to electrically activated explosive devices, a power conditioning unit (PCU) and input/output (I/O) interface, wherein the I/O interface is to receive vehicle location data from an onboard GPS receiver and communicate with the DIU via the serial bus interface, the I/O interface and the serial bus interface being configured to allow GPS, guidance, attitude control and other stage-related data to be forwarded to the DIU to allow the DIU to trigger an ejection of the third stage by activating the electrical explosive devices.

5. The multi-stage missile of claim 4 wherein the second stage includes a second stage electronics package coupled to the DIU via the serial bus interface, the second stage including an IMU, a second stage linear shaped charge (LSC) for mechanical separation of the second stage, and an I/O controller to collect telemetry and IMU data to be forwarded to the DIU over the serial bus to allow the DIU to trigger an ejection of the second stage.

6. The multi-stage missile of claim 5 wherein the first stage includes a first stage electronics package including a thrust vector controller (TVC), TVC drivers, separation ordinance and a first stage LSC for mechanical separation of the first stage, the first stage being coupled to the DIU via the serial bus interface to allow the DIU to trigger an ejection of the first stage.

7. The multi-stage missile of claim 6 wherein the DIU is configured to perform guidance and navigation functions for the first, second, third and fourth stages based on stage-control instructions for an associated stage, and wherein the DIU is configured to perform control functions for only the second, third and fourth stages based on stage-control instructions for an associated stage.

8. The multi-stage missile of claim 2 wherein the serial bus interface is an IEEE 1394b configured interface with a physical layer interface and a link layer interface.

9. A method for controlling a plurality of stages of multi-stage missile, the plurality of stages adapted to be physically coupled to and decoupled from adjacent stages, the method comprising:

performing guidance and navigation functions for each of the stages and control functions for only some of the stages with a digital interface unit (DIU) disposed on a final stage; and providing a daisy-chain interconnection between the stages with a serial bus interface that couples the DIU to electronic circuitry on each of the stages, wherein the method includes:

configuring a guidance processor with stage-control instructions to perform the guidance and navigation functions of the stages using a field programmable gate array (FPGA) that configures the guidance processor with the stage-control instructions for a currently-controlled stage; and executing stage-control instructions for the currently-controlled stage prior to separation of the currently-controlled stage.

10. The method of claim 9 further comprising configuring the DUI to order stage separation and provide a stage-gone signal to the guidance processor, and wherein the stage-control instructions are configured to check for the presence of the stage-gone signal and cause the FPGA to configure the guidance processor with stage-control instructions for controlling a next stage in response thereto.

* * * * *

UNITED STATES PATENT AND TRADEMARK OFFICE

CERTIFICATE OF CORRECTION

PATENT NO. : 8,104,719 B2
APPLICATION NO. : 11/281804
DATED : January 31, 2012
INVENTOR(S) : Chin Shiau et al.

It is certified that error appears in the above-identified patent and that said Letters Patent is hereby corrected as shown below:

On the Title page, in field (54), in "Title", in column 1, line 3, delete "MISSLE" and insert -- MISSILE --, therefor.

Title page 2, under "Other Publications", in column 1, line 3, below "Internet." delete "URL addresses not considered to be documents.".

In Drawings

Sheet 3 of 6, Box no. 26, Figure 2b, line 3, delete "Ordnance" and insert -- Ordinance --, therefor.

In column 1, line 3, delete "MISSLE" and insert -- MISSILE --, therefor.

Signed and Sealed this
Seventeenth Day of April, 2012

David J. Kappos

David J. Kappos
*Director of the United States Patent and Trademark Office*